US011913220B2

(12) United States Patent
Moshenberg

(10) Patent No.: US 11,913,220 B2
(45) Date of Patent: Feb. 27, 2024

(54) THERMAL ISOLATOR

(71) Applicant: Alex Moshenberg, Salisbury Mills, NY (US)

(72) Inventor: Alex Moshenberg, Salisbury Mills, NY (US)

( * ) Notice: Subject to any disclaimer, the term of this patent is extended or adjusted under 35 U.S.C. 154(b) by 0 days.

(21) Appl. No.: 17/881,839

(22) Filed: Aug. 5, 2022

(65) Prior Publication Data

US 2023/0044743 A1 Feb. 9, 2023

Related U.S. Application Data

(60) Provisional application No. 63/230,479, filed on Aug. 6, 2021.

(51) Int. Cl.
*E04B 1/76* (2006.01)
*E04B 1/80* (2006.01)

(52) U.S. Cl.
CPC ..... *E04B 1/7612* (2013.01); *E04B 1/806* (2013.01)

(58) Field of Classification Search
CPC ..... E04B 1/7612; E04B 1/806; E04F 13/0805
USPC ..... 52/404.1
See application file for complete search history.

(56) References Cited

U.S. PATENT DOCUMENTS 6,125,608 A * 10/2000 Charlson ..... F16B 33/02 52/847
8,919,070 B2 * 12/2014 Moses ..... E04F 13/0805 52/704
8,973,334 B2 * 3/2015 Croasdale ..... E04F 13/0733 52/717.02
9,334,646 B2 * 5/2016 Hohmann, Jr. ..... E04B 1/4185
9,499,974 B2 * 11/2016 Bombino ..... E04F 13/0805
9,587,399 B2 * 3/2017 Jakobsen ..... E04B 1/7608
9,856,655 B2 * 1/2018 Knight ..... E04F 13/0862
10,011,997 B1 * 7/2018 Bilge ..... E04F 13/0801
10,273,686 B2 * 4/2019 Lake ..... E04B 1/7612
2012/0186178 A1 * 7/2012 Westra ..... E04B 1/7675 52/762
2013/0074431 A1 * 3/2013 Croasdale ..... E04F 13/0805 52/309.4

(Continued)

FOREIGN PATENT DOCUMENTS

CA 2763058 A1 * 3/2012 ..... E04B 1/40
DE 19653672 C2 * 9/2000 ..... E04B 1/7612

(Continued)

*Primary Examiner* — James M Ference
(74) *Attorney, Agent, or Firm* — Snell & Wilmer L.L.P.

(57) ABSTRACT

A thermal isolator system may comprise a thermal isolator configured to be coupled to an inner wall of a wall system, and a first retainer comprising a first coupling protrusion having a first protrusion shape. The thermal isolator may comprise an isolator body spanning between an isolator outer surface and an isolator inner surface and between an isolator first side and an isolator second side, and a first coupling recess disposed through the isolator outer surface and into the isolator body. The first coupling recess may comprise a recess shape, and the first protrusion shape of the first coupling protrusion may be complementary to the recess shape of the first coupling recess. The first retainer may be configured to be coupled to the thermal isolator by the first coupling protrusion being disposed in the first coupling recess of the thermal isolator.

20 Claims, 8 Drawing Sheets

(56) References Cited

U.S. PATENT DOCUMENTS

| | | | | |
|---|---|---|---|---|
| 2013/0174506 | A1* | 7/2013 | Bombino | E04B 1/7612 52/750 |
| 2013/0247483 | A1* | 9/2013 | Hohmann, Jr. | E04B 1/4178 52/707 |
| 2013/0247498 | A1* | 9/2013 | Hohmann, Jr. | E04B 1/4178 52/712 |
| 2013/0340371 | A1* | 12/2013 | Bronner | E04F 13/0862 52/562 |
| 2014/0059972 | A1* | 3/2014 | Moses | E04F 13/0857 52/749.1 |
| 2014/0325928 | A1* | 11/2014 | White | F25D 23/085 52/506.05 |
| 2015/0128518 | A1* | 5/2015 | Knight | E04F 13/0864 52/404.1 |
| 2015/0176268 | A1* | 6/2015 | Knight | E04B 2/58 52/404.2 |
| 2015/0184376 | A1* | 7/2015 | Croasdale | E04B 1/7637 52/407.4 |
| 2016/0032582 | A1* | 2/2016 | Hohmann, Jr. | E04B 1/4178 52/703 |
| 2016/0053494 | A1* | 2/2016 | White | F25D 23/085 52/698 |
| 2018/0148926 | A1* | 5/2018 | Lake | E04B 2/967 |
| 2021/0310252 | A1* | 10/2021 | Hatzinikolas | E04F 13/14 |
| 2023/0044743 | A1* | 2/2023 | Moshenberg | E04B 1/806 |

FOREIGN PATENT DOCUMENTS

| | | | | |
|---|---|---|---|---|
| EP | 2775062 | A1 * | 9/2014 | E04B 1/7608 |
| FR | 3057885 | A1 * | 4/2018 | E04B 1/7675 |

* cited by examiner

100C

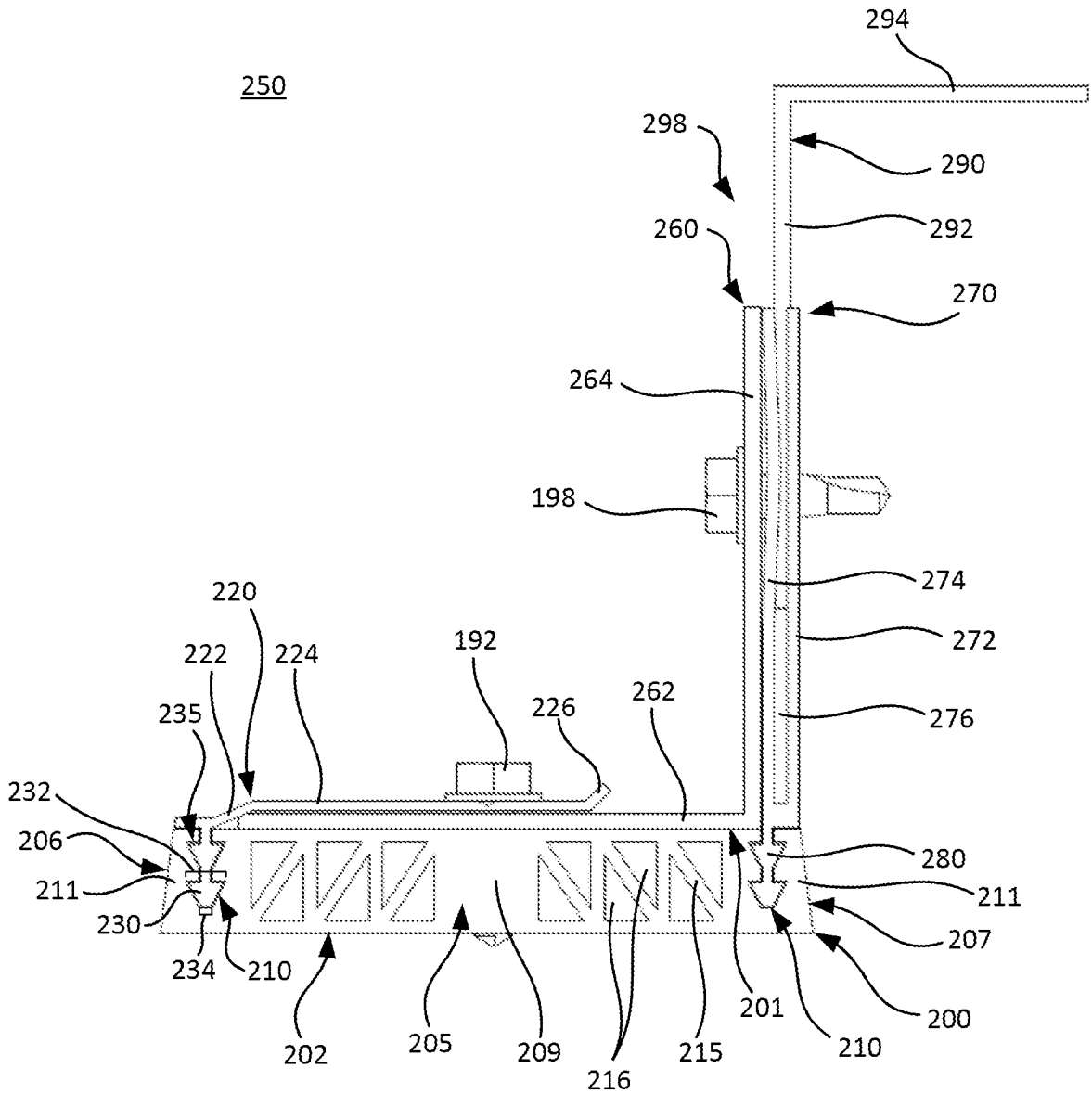
FIG. 2B
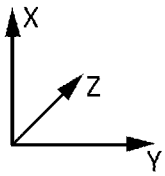

THERMAL ISOLATOR

CROSS-REFERENCE TO RELATED APPLICATIONS

This application is a nonprovisional of, and claims priority to and the benefit of, U.S. Provisional Patent Application No. 63/230,479, filed Aug. 6, 2021 and entitled "THERMAL ISOLATOR," which is hereby incorporated by reference herein.

FIELD

This application generally relates to thermal isolators, and more specifically, to thermal isolators incorporated into wall systems for buildings.

BACKGROUND

Wall systems for buildings may comprise multiple layers. The multiple layers may perform a variety of functions, such as strengthening the structure of the building, providing protection for the building interior, and/or providing thermal insulation such that the effect of the exterior climate on the interior building temperature is lessened or minimized. Therefore, certain components may be utilized in wall systems to separate and/or provide a boundary between conductive materials, and/or between conductive materials and the more inward wall system components or the building interior, to prevent or mitigate against the transfer of thermal energy through the wall system.

SUMMARY OF THE DISCLOSURE

The present disclosure relates to a thermal isolators, such as those incorporated into wall systems for buildings. In various embodiments, a wall system may comprise an inner wall comprising an inner wall surface; and a system comprising a thermal isolator, wherein the thermal isolator is coupled to the inner wall surface. In various embodiments, the wall system may further comprise insulation disposed along an isolator outer surface of the thermal isolator and supported by a sub-framing system coupled to the thermal isolator.

In various embodiments, a system may comprise a thermal isolator configured to be coupled to an inner wall of a wall system, and a first retainer comprising a first coupling protrusion having a first protrusion shape. The thermal isolator may comprise an isolator body spanning along a first axis between an isolator outer surface and an isolator inner surface and along a second axis between an isolator first side and an isolator second side, and a first coupling recess disposed through the isolator outer surface and into the isolator body. The first axis and the second axis may be substantially perpendicular. The first coupling recess may comprise a recess shape. The first protrusion shape of the first coupling protrusion may be complementary to the recess shape of the first coupling recess. The first retainer may be configured to be coupled to the thermal isolator by the first coupling protrusion being disposed in the first coupling recess of the thermal isolator. In various embodiments, the isolator body may comprise a solid portion that is solid between the isolator outer surface and the isolator inner surface. In various embodiments, the thermal isolator may comprise a coupling void disposed through the isolator body from the isolator outer surface to the isolator inner surface configured to receive a fastener to fasten the thermal isolator to the inner wall, wherein the coupling void may be disposed through the solid portion of the isolator body.

In various embodiments, the first coupling recess may be disposed proximate the isolator first side or the isolator second side. In various embodiments, the first coupling recess may be disposed proximate the isolator first side and a first distance therefrom, wherein the thermal isolator may comprise comprises a second coupling recess disposed proximate the second side and a second distance therefrom. In various embodiments, the first distance and the second distance may be the same. In various embodiments, the system may further comprise a second retainer comprising a second coupling protrusion having a second protrusion shape complementary to a second recess shape of the second coupling recess, wherein the second retainer may be configured to be coupled to the thermal isolator by the second coupling protrusion being disposed in the second coupling recess of the thermal isolator.

In various embodiments, the first protrusion shape may comprise a first portion comprising a first cross-sectional length, and a second portion comprising a second cross-sectional length that is protruding further than the first portion, wherein the first cross-sectional length may be greater than the second cross-sectional length. In various embodiments, the first coupling recess maybe disposed proximate the isolator first side or the isolator second side of the thermal isolator, such that, in response to the first coupling protrusion being inserted into the first coupling recess, a respective end portion of the thermal isolator between the first coupling protrusion and a respective isolator end may be able to shift from an original position to allow the first cross-sectional length into the first coupling recess, and shift back substantially to the original position in response to the first cross-sectional length crossing the isolator outer surface into the first coupling recess.

In various embodiments, the thermal isolator may comprise a proximal end and a distal end, wherein the isolator body spans an isolator length between the proximal end and the distal end along a third axis, wherein the third axis may be substantially perpendicular to the first axis and the second axis. The thermal isolator may comprise a breakage line spanning between a first side and a second side of the thermal isolator at a position along the isolator length, wherein the breakage line comprises a line along which the thermal isolator may be broken to shorten the isolator length.

In various embodiments, the first coupling recess may span along the outer surface of the thermal isolator between a proximal end and a distal end of the thermal isolator for a length longer than a length of the coupling protrusion of the first retainer, which may allow the retainer to be coupled to the thermal isolator at a desired position.

In various embodiments, the isolator body may comprise at least one hollow void spanning internally therein and between the isolator outer surface and the isolator inner surface. In various embodiments, the hollow void is disposed between the solid portion of the isolator body and at least one of the isolator first side and the isolator second side.

In various embodiments, the system may further comprise a sub-framing system comprising a foundation portion coupled to the thermal isolator by the first retainer and an extension portion extending away from the isolator outer surface. In various embodiments, the first retainer may span along the isolator outer surface to couple the foundation portion of the sub-framing system to the isolator outer surface, and wherein a second retainer extends outwardly from the isolator outer surface and is configured to at least one of contact or support the extension portion of the sub-framing system. In various embodiments, the sub-framing system may comprise a sub-framing member having an L-shape. In various embodiments, the sub-framing member may comprise a sub-framing member having a Z-shape. In various embodiments, the sub-framing system may comprise a first sub-framing member comprising the foundation portion and the extension portion, and a second sub-framing member coupled to the second retainer and extending outwardly from the isolator outer surface, wherein the extension portion of the first sub-framing member and the second sub-framing member at least partially overlap.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures. Elements with like element numbering throughout the figures are intended to be the same.

FIG. 2B illustrates a different view of the thermal isolator system of FIG. 2A, in accordance with various embodiments.

DETAILED DESCRIPTION

All ranges may include the upper and lower values, and all ranges and ratio limits disclosed herein may be combined. It is to be understood that unless specifically stated otherwise, references to "a," "an," and/or "the" may include one or more than one, and that reference to an item in the singular may also include the item in the plural.

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, and mechanical changes may be made without departing from the scope of the disclosure. Thus, the detailed description herein is presented for purposes of illustration only and not of limitation. For example, the steps recited in any of the method or process descriptions may be executed in any combination or order and are not necessarily limited to the order or combination presented. Furthermore, any reference to singular includes plural embodiments, and any reference to more than one component or step may include a singular component or step. Also, any reference to attached, fixed, connected, or the like may include permanent, removable, temporary, partial, full, and/or any other possible attachment option. Additionally, any reference to without contact (or similar phrases) may also include reduced contact or minimal contact.

As used herein, "outward," "outer," or like terms refer to a direction or relative position or arrangement toward an external environment to a building or wall system, and "inward," "inner," or like terms refer to a direction or relative position or arrangement toward an interior of a building or wall system (e.g., a building interior).

Figure 1A:
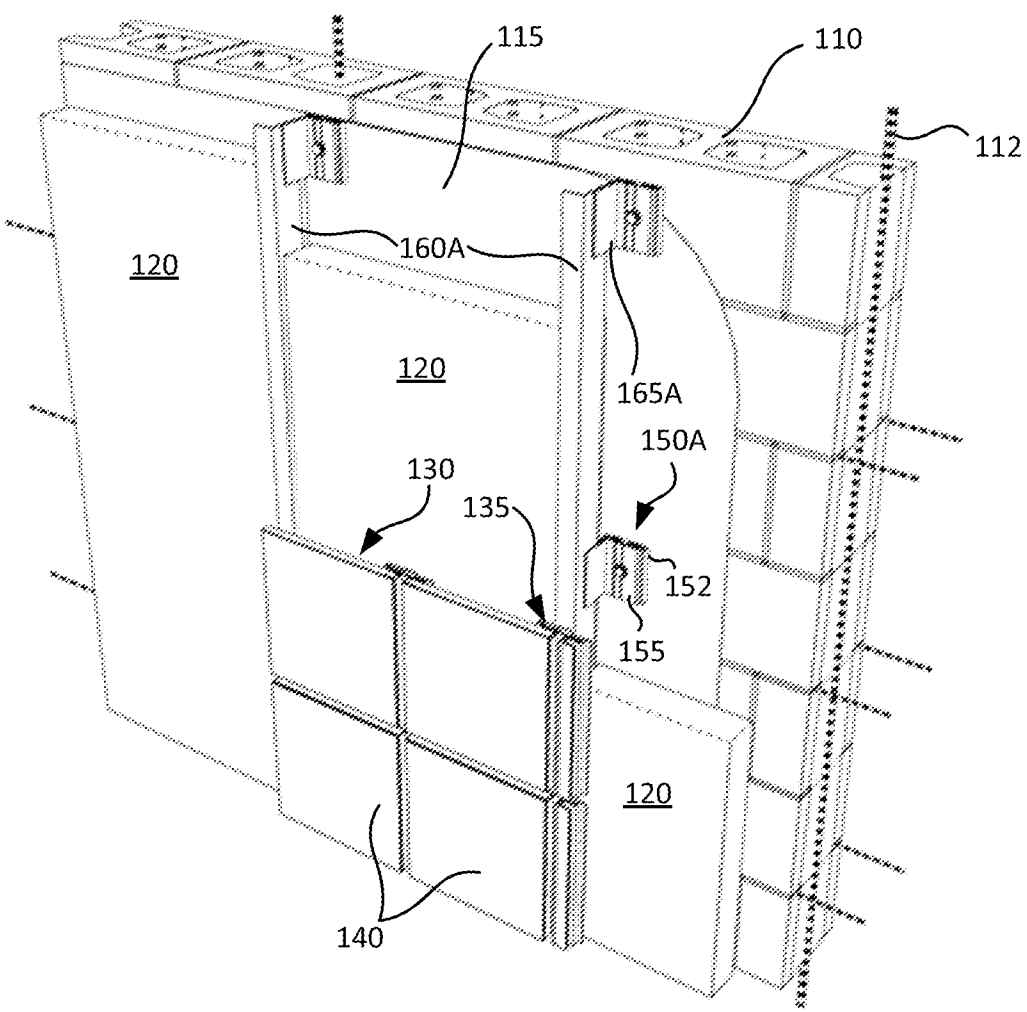
FIG. 1A illustrates a wall system, in accordance with various embodiments.
Figure 1B:
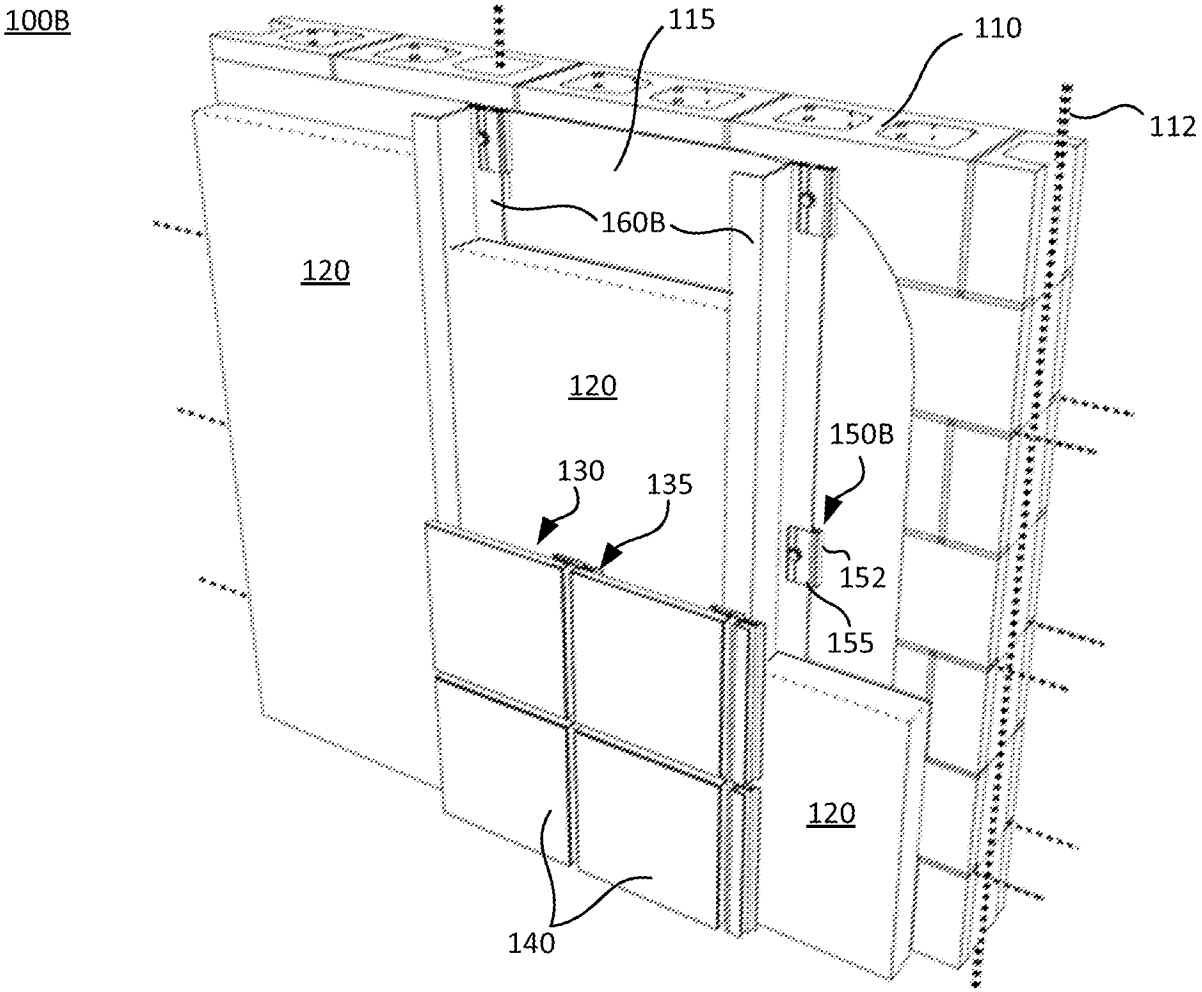
FIG. 1B illustrates another wall system, in accordance with various embodiments.
Figure 1C:
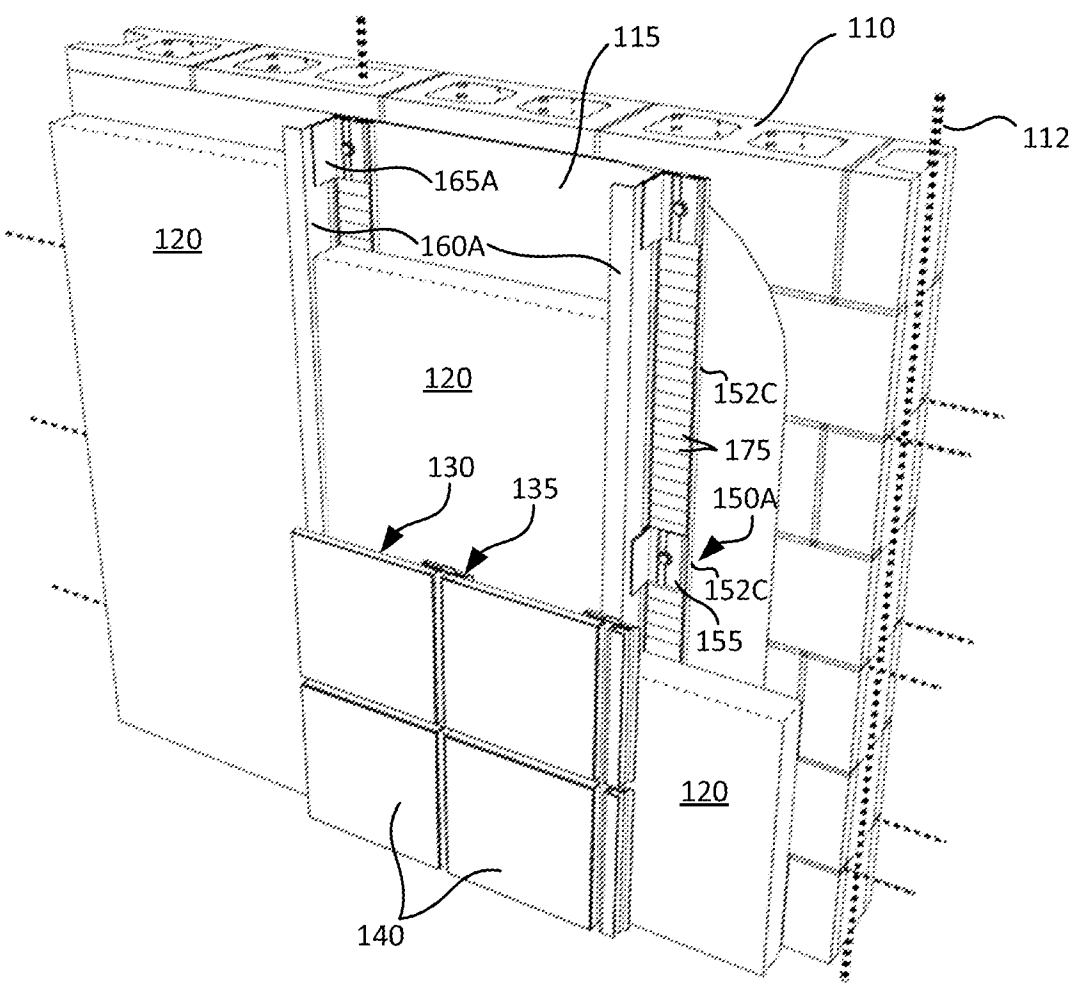
FIG. 1C illustrates another wall system, in accordance with various embodiments.

With reference to FIGS. 1A-1C (which provide views of wall systems with various portions removed to see the various inner components), in various embodiments, a wall system (e.g., wall systems 100A, 100B, or 100C) may comprise an inner wall (e.g., inner wall 110), insulation (e.g., insulation 120) coupled to the inner wall, and/or an outer wall panel (e.g., outer wall panels 140). The insulation may be disposed between the inner wall and the outer wall panels. Insulation may comprise any suitable material, such as cellulose, fiberglass, mineral wool (e.g., comprising rock or slag), polyisocyanurate, polyurethane, phenolic, aerogel (fumed silica), extruded polystyrene, expanded polystyrene, polyamide, vacuum insulated panels, and/or the like. The insulation may be configured to provide protection to inner components of the wall system and/or insulate such inner components and the building interior from external conditions (e.g., by preventing or reducing the transfer of thermal energy between the interior of the building and the exterior environment through the wall system). The inner wall may comprise cinder, concrete, masonry, a polymeric material, wood, and/or any other suitable material (e.g., a wall comprising cold-formed metal framing, concrete masonry units, wood framing, steel framing, cast-in-place concrete, and/or cross-laminated timber) (e.g., FIGS. 1A-1C depicts inner wall 110 comprising cinder blocks). In various embodiments, a wall system may comprise a weather-resistant barrier (e.g., barrier 115). A weather resistant barrier may couple to the inner wall, and may prevent or mitigate, or control the amount of, air and/or moisture flowing through the inner wall. A weather resistant barrier may comprise a polymeric material (e.g., plastic lumber), oriented strand board, gypsum board, cement board, magnesium oxide board, and/or any other suitable material. In various embodiments, the inner wall may comprise reinforcement structural components, such as reinforcement bars 112, wood studs, cross-laminated timber, steel studs, cold-formed metal framing, and/or the like.

In various embodiments, the insulation in a wall system may be retained therein and/or coupled to the inner wall by sub-framing members (i.e., framing members, girts, sub-girts, and/or the like) comprised in a sub-framing system. The sub-framing members in a sub-framing system may comprise any suitable shape, combination, or configuration. As referred to herein, a "sub-framing system" may comprise the sub-framing member(s) spanning along a wall system to retain and/or couple the insulation to the inner wall. In various embodiments, the sub-framing member(s) in a sub-framing system may span any suitable length, height, or other dimension of a wall system, and such span of the sub-framing member(s) may be continuous, singular, and/or intermittent along a dimension of the wall system. For example, sub-framing members 160A in the sub-framing systems depicted in FIGS. 1A and 1C may continuously span at least a portion of the height of wall systems 100A and 100C. Sub-framing members 165A, on the other hand, may be provided or coupled in the wall system intermittently along the height of wall systems 100A and 100C. As another example, sub-framing members 160B in the sub-framing systems depicted in FIG. 1B may continuously span at least a portion of the height of wall system 100B.

In various embodiments, a sub-framing system may comprise an extension portion that extends outwardly from the inner wall (e.g., substantially perpendicularly form the inner wall), and a retention portion that extends substantially parallel to the inner wall and/or substantially perpendicularly from the extension portion (as used in this context, "substantially" within 20 degrees of parallel or perpendicularity). The insulation of a wall system may be disposed in the space between the retention portion of a sub-framing system and the inner wall (which would make the depth of the space about as long as the extension portion of the sub-framing system). The retention portion of a sub-framing system may retain the insulation in place and/or couple the insulation to other components of the wall system (e.g., the inner wall). Sub-framing systems may be disposed intermittently between sides of a wall system, wherein panels of insulation are disposed between two sub-framing systems (e.g., insulation panels 120 between the sub-framing systems depicted in FIGS. 1A-1C).

A sub-framing member in a sub-framing system may comprise any suitable shape. In various embodiments, a sub-framing system may comprise two L-shaped sub-framing members. For example, the sub-framing systems depicted in FIGS. 1A and 1C comprise sub-framing members 160A and 165A, which are L-shaped. In FIGS. 1A and 1C, the extension portion of the sub-framing systems comprises portions of sub-framing members 160A and 165A, and the retention portion comprises a portion of sub-framing members 160A (i.e., sub-framing members 160A provide the retention portions, and sub-framing members 160A and 165A provide the extension portions of the sub-framing systems). In various embodiments, a sub-framing system may comprise a Z-shaped sub-framing members. For example, the sub-framing systems depicted in FIG. 1B comprise sub-framing members 160B, which are Z-shaped. In FIG. 1B, sub-framing members 160B comprises and provides both the extension portion and the retention portion of the sub-framing systems.

In various embodiments, the outer wall panels (i.e., cladding) of a wall system (e.g., outer wall panels 140) may be configured to protect the inward wall system components (i.e., the components inward of the outer wall panels) from external forces and wear, such as from weather. The outer wall panels may couple to other components of the wall system, such as a sub-framing member of a sub-framing system and/or insulation. The outer wall panels may be coupled to components of the wall system via coupling brackets (e.g., coupling brackets 135). For example, as shown in FIGS. 1A-1C, outer wall panels 140 may be coupled to insulation 120 or a sub-framing member of a sub-framing system via coupling brackets 135 (e.g., in FIGS. 1A and 1C, outer wall panels 140 may be coupled to sub-framing members 160A, and in FIG. 1B, outer wall panels 140 may be coupled to sub-framing members 160B). Outer wall panels may comprise any suitable materials (e.g., metal composite material (MCM), aluminum composite material (ACM), metal, porcelain, insulated metal, fiber cement, fiber concrete, ultra-high performance concrete (UHPC), glass fiber reinforced concrete (GFRC), high pressure laminate (HPL), laminate, wood, terracotta, brick, thin-brick, stucco, ceramic, stone, honeycomb-backed laminate, reinforced fiberglass), and may comprise a veneer or other outer surface design to achieve a desired outer appearance.

In various embodiments, the components of a wall system may be disposed against and/or adjacent to one another. For example, a thermal isolator (discussed further herein) and/or insulation may be disposed adjacent to the inner wall, the insulation may be disposed adjacent to the sub-framing members, and/or the outer wall panels may be disposed adjacent to the insulation and/or sub-framing members. In various embodiments, there may be spaces or voids between any two of the components of a wall system.

In various embodiments, there may be a void or air space (e.g., a rain screen) between the insulation and the outer wall panel of a wall system. For example, wall systems 100A-100C may comprise air space 130 between insulation 120 and outer wall panels 140. The air space between the insulation and the outer wall panels of a wall system may comprise any suitable width. For example, the air space may be between zero and 24 inches, or between 5 and 10 inches, or between zero and 5 inches, or between 0.25 and 2 inches between the insulation and the outer wall panels of a wall system. The air space may be created by the thickness of the coupling brackets coupling the outer wall panels to the insulation and/or sub-framing members. The air space may be configured to create an air gap and/or ventilation gap or space between the outer wall panel and the other components of the wall system. Therefore, conditions experienced by the outer surface of the outer wall panels (e.g., weather and/or temperature conditions) may not be transferred to the more inner components of the wall system. If fluid gets into the wall system (e.g., through the outer wall panel or otherwise internal to the outer wall panel), the air space can allow drainage and/or evaporation of such fluid. For example, weather (e.g., precipitation) may be drained through the air space, and/or thermal energy transfer between outer wall panels 140 and insulation 120 and/or sub-framing members (e.g., sub-framing members 160A or 160B) may be mitigated and/or prevented. Therefore, any temperature control in the interior of the building having the wall system may be less affected by conditions external to the outer wall panels.

In various embodiments, the sub-framing system may be coupled to another component in the wall system (e.g., the inner wall) by a thermal isolator system. For example, in FIGS. 1A and 1C, the sub-framing systems comprising sub-framing members 160A and 165A may be coupled to inner wall 110 by thermal isolator systems 150A. As another example, in FIG. 1B, the sub-framing systems comprising sub-framing members 160B may be coupled to inner wall 110 by thermal isolator systems 150B. A thermal isolator system may comprise a thermal isolator (e.g., thermal isolator 152) and/or one or more retainers coupled to the thermal isolator (e.g., retainers 155 shown in FIGS. 1A-1C). The thermal isolator may be disposed between the sub-framing member(s) and the inner wall or other wall system component. The retainers may be configured to couple a sub-framing member of the respective sub-framing system to the thermal isolator.

Figure 2A:
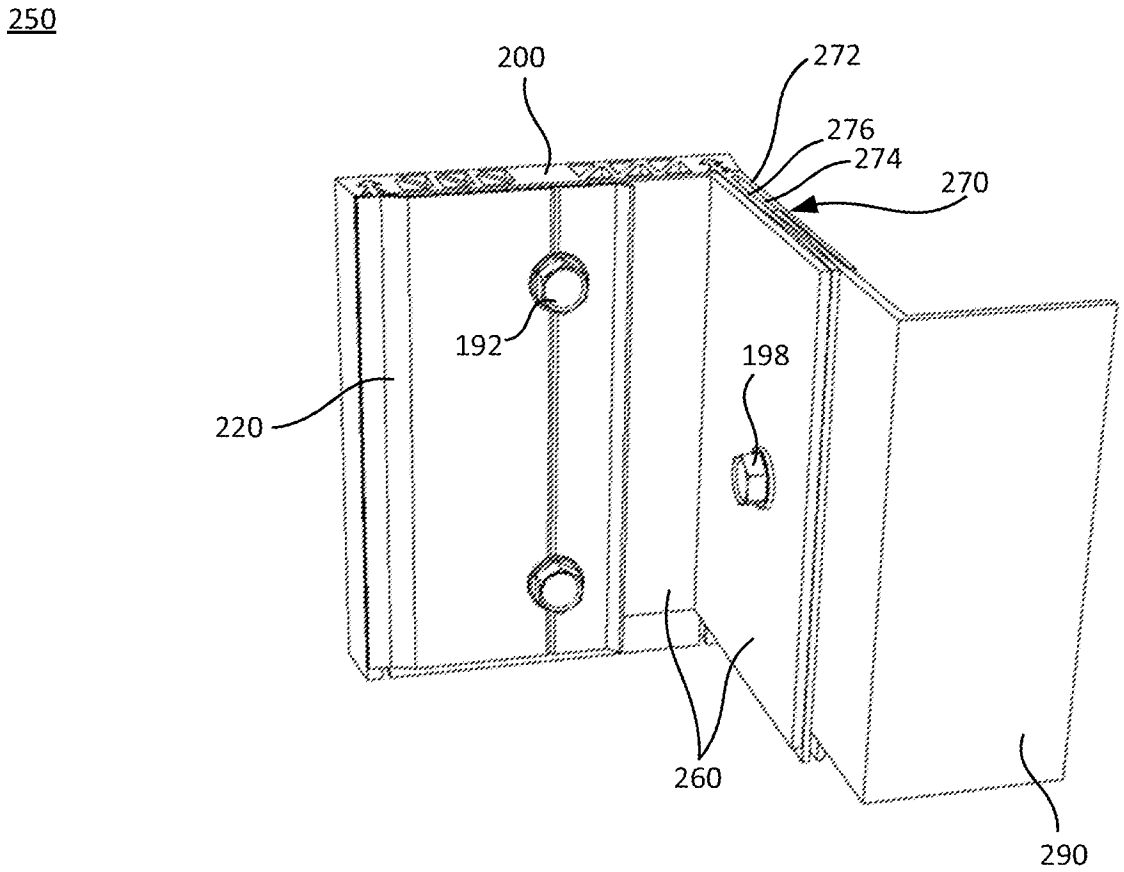
FIG. 2A illustrates a perspective view of a thermal isolator system, in accordance with various embodiments.
Figure 2C:
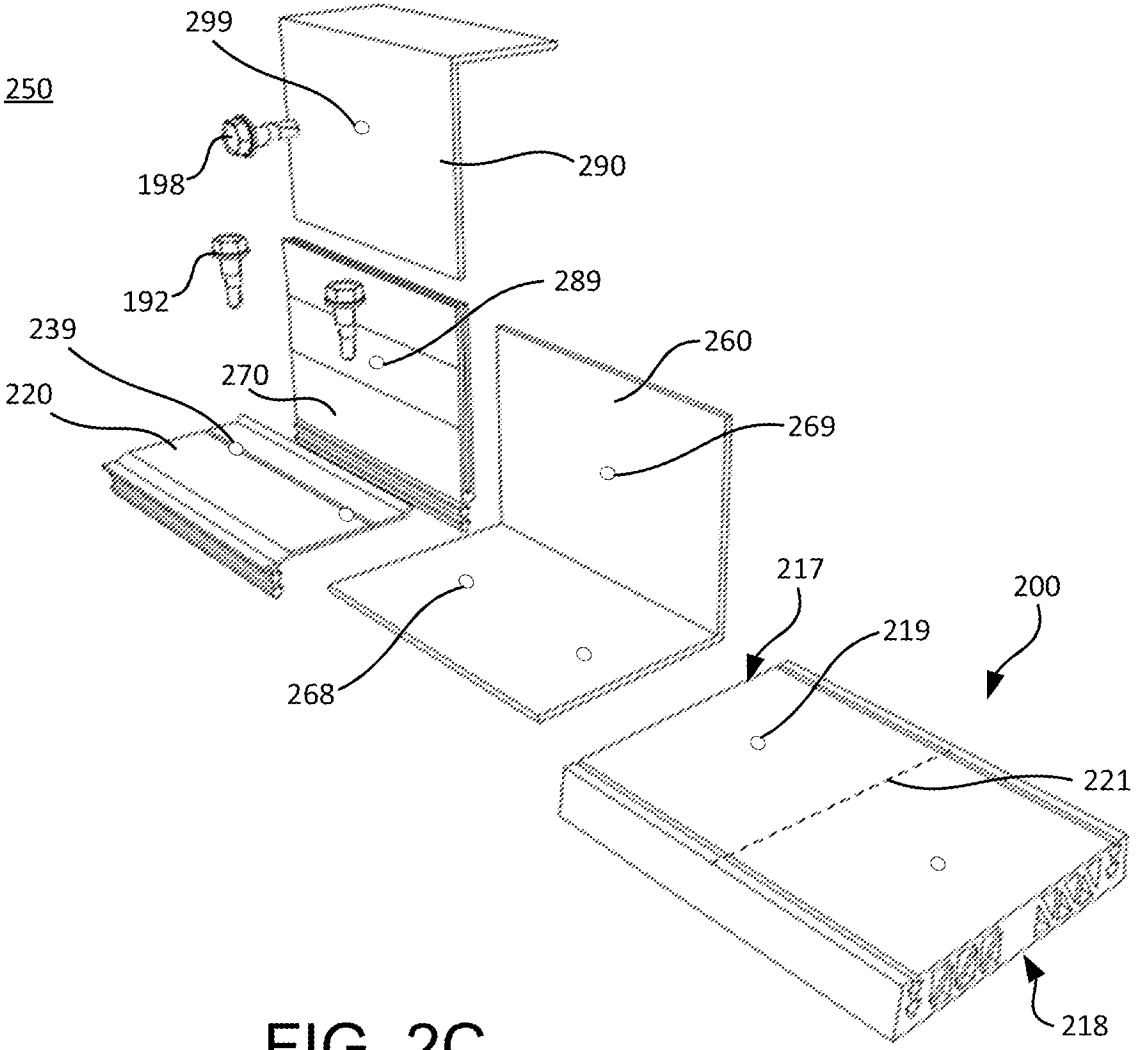
FIG. 2C illustrates an exploded view of the thermal isolator system of FIGS. 2A and 2B, in accordance with various embodiments.

In various embodiments, a thermal isolator system may comprise a thermal isolator, a retainer system (comprising a retainer(s)), and/or a sub-framing system (comprising a sub-framing member(s)). With reference to FIGS. 2A-2C, thermal isolator system 250 may comprise a thermal isolator 200. Thermal isolator 200 may be configured to couple a sub-framing member(s) (e.g., first sub-framing member 260 and second sub-framing member 290) to another component of a wall system (e.g., an inner wall). Thermal isolator 200 may be configured to be disposed between the sub-framing member(s) and another component of a wall system. Therefore, thermal isolator 200 may separate and/or isolate (e.g., physically, thermally, electrically, etc.) the sub-framing member(s), each other, fasteners, and from the other components of a wall. Accordingly, the thermal isolator prevents or mitigates the transfer of energy (e.g., thermal or electrical energy) between a sub-framing member (which may comprise a metal or other conductive material, and/or pultruded fiberglass or fiber-reinforced polymer) and another component of a wall system (e.g., an inner wall or other wall system component that is more inward than the respective sub-framing member(s)). That way, external conditions may not affect, or may have less of an effect, on the interior of the building having the wall system, because the transfer of thermal energy from the building exterior to the building interior, and vice versa, is prevented or lessened.

In various embodiments, a thermal isolator (e.g., thermal isolator 200) may comprise an isolator body (e.g., isolator body 205) spanning in a first direction along a first axis X between an isolator outer surface (e.g., isolator outer surface 201) and an isolator inner surface (e.g., isolator inner surface 202), and spanning in a second direction along a second axis Y between an isolator first side (e.g., isolator first side 206) and an isolator second side (e.g., isolator second side 207). In various embodiments, the first and second directions and/or axes may be substantially perpendicular to one another ("substantially" in this context means within 20 degrees of perpendicular). A thermal isolator may comprise a proximal end (e.g., proximal end 217) and a distal end (e.g., distal end 218), wherein the isolator body also spans in a third direction along a third axis Z between the proximal end and the distal end. The third direction and/or axis may be substantially perpendicular to the first and second directions and/or axes ("substantially" in this context means within 20 degrees of perpendicular).

In various embodiments, a thermal isolator and/or any portion thereof may comprise any suitable shape. For example, the isolator outer and/or inner surface, or the surfaces of the proximal and distal ends, or any other surfaces, each may comprise a rectangular shape (e.g., isolator outer surface 201, isolator inner surface 202, and surfaces of first side 206 and second side 207 depicted in FIGS. 2A-2C). In various embodiments, a surface may comprise a trapezoid, for example, if the opposing surfaces across the isolator body are substantially parallel but one comprises a greater surface area than the other (e.g., proximal end 217 and distal end 218 may comprise trapezoidal shapes because outer surface 201 may comprise a smaller surface area than inner surface 202).

In various embodiments, the isolator inner surface of a thermal isolator may be configured to couple to another component of a wall system that is more inward (i.e., toward the interior of the building) than the thermal isolator. For example, isolator inner surface 202 may be configured to couple to an inner wall (e.g., inner wall 110 shown in FIGS. 1A-1C). Along similar lines, in various embodiments, the isolator outer surface of a thermal isolator may be configured to couple to another component of the wall system that is more outward (i.e., toward the exterior of the building) than the thermal isolator (e.g., a sub-framing member, such as first sub-framing member 260 and/or second sub-framing member 290).

In various embodiments, a thermal isolator may be coupled to a more inward component of the wall system (e.g., the inner wall) in any suitable manner. For example, a thermal isolator may be coupled to an inner wall via adhesive or one or more coupling devices, such as a retainer or a fastener (e.g., bolt, screws, nails, or the like) disposed through the thermal isolator. As shown in FIGS. 2A-2C, bolts 192 may be disposed through thermal isolator 200 (e.g., through coupling void 219 in isolator body 205). Bolts 192 may be configured to span through isolator body 205 and into the inner wall (or a complementary receptacle in the inner wall). Bolts 192 may be tightened such that pressure is applied to isolator outer surface 201. Such pressure, along with bolts 192, may hold thermal isolator 200 in place.

In various embodiments, the isolator body of a thermal isolator may comprise at least one solid portion (i.e., a portion of the isolator body that is solid at least partially between the isolator inner and outer surfaces, at least partially between the isolator first and second sides, and/or at least partially between the isolator proximal and distal ends). For example, thermal isolator 200 comprises solid portion 209 spanning between isolator outer surface 201 and isolator inner surface 202, between isolator first side 206 and isolator second side 207, and between proximal end 217 and distal end 218. In various embodiments, the solid portion of a thermal isolator may be disposed in a middle portion of the isolator body. As shown in FIGS. 2A-2C, solid portion 209 is disposed in a middle portion of isolator body 205 (the middle portion being a portion, on either side of which there is a substantially equal length and/or width of the isolator body, wherein "substantially" in this context means within 20 percent). In various embodiments, a coupling device, such as bolts 192, may be disposed through the solid portion of an isolator body, such that more material of the isolator body contacts the coupling device, thereby providing more stability of the coupling between the thermal isolator, the coupling device (e.g., bolt), and the other wall system component (e.g., an inner wall). The coupling device being disposed through the solid portion of the isolator body also provides a better seal of the coupling void disposed therethrough (e.g., coupling void 219), thus preventing or mitigating the risk of weather (e.g., moisture or fluid) traveling along the coupling device and through coupling void 219 (e.g., which may cause rust, mold, or other undesirable effects).

In various embodiments, the isolator body of a thermal isolator may comprise at least one hollow void (i.e., a portion of the isolator body that is hollow at least partially between the isolator inner and outer surfaces, at least partially between the isolator first and second sides, and/or at least partially between the isolator proximal and distal ends). A hollow void may be disposed between a solid portion of an isolator body and the isolator first or second side. For example, thermal isolator 200 comprises hollow voids 216 spanning at least partially between isolator outer surface 201 and isolator inner surface 202, least partially between isolator first side 206 and isolator second side 207, and least partially between proximal end 217 and distal end 218. Hollow voids within an isolator body may remove material (e.g., between the isolator inner surface and the isolator outer surface), thus decreasing material available for energy transfer through the isolator body. The hollow voids may also allow the thermal isolator to absorb pressure loads (e.g., acting as a shock or cushion) by making the isolator body more flexible than a completely solid body. Additionally, the hollow voids may allow fluid to flow through the thermal isolator. For example, air or water that penetrates the wall system may be allowed to travel through the thermal isolator at least partially via the hollow voids, thus providing drainage and/or evaporation through the wall system. The hollow voids may also retain and/or trap fluid for thermal purposes. As shown in FIGS. 2A-2C, isolator body 205 may comprise six sets of hollow voids 216 (three sets on each side of solid portion 209). To maintain or add sufficient structural strength, a support beam may be disposed in or through a hollow void. For example, each set of hollow voids 216 may be a single hollow void with a support beam 215 disposed therethrough. The hollow voids through an isolator body may be disposed in any suitable arrangement and/or shape (e.g., an equal number and/or size of hollow voids may be disposed on either side of the isolator body, as divided by a center line disposed between the isolator first and second sides and spanning from the isolator proximal end to the distal end).

In various embodiments, a thermal isolator may comprise one or more coupling recesses disposed through the isolator outer surface and into the isolator body. A coupling recess may be configured to receive a complementary protrusion from a sub-framing member coupling device (e.g., a retainer) configured to couple a sub-framing member to the thermal isolator. A coupling recess(es) may be disposed in any suitable location along an isolator outer surface (e.g., spanning at least partially along an edge or surface of a thermal isolator). For example, thermal isolator 200 may comprise coupling recesses 210, wherein a first coupling recess 210 is disposed proximate isolator first side 206, and a second coupling recess 210 is disposed proximate isolator second side 207. Each coupling recess 210 may be disposed an equal distance from the respective isolator side or edge. That is, the first coupling recess 210 may be disposed a first distance from isolator first side 206, and the second coupling recess 210 may be disposed a second distance from isolator second side 207, wherein the first and second distances may be the same. In various embodiments, a thermal isolator may comprise the same features on either side of a center line disposed between the isolator first and second sides and spanning from the isolator proximal end to the distal end. For example, thermal isolator 200 may have a solid portion 209 in the middle of isolator body 205, and on each side of the solid portion 209, there may be three sets of hollow voids 216 with support beams 215 between the two hollow voids 216 in each set, and a coupling recess 210 spaced equally from the respective isolator first side 206 and isolator second side 207. Thus, thermal isolator 200 may be the same on each side of a center line disposed between the isolator first and second sides and spanning from the isolator proximal end to the distal end (i.e., making the thermal isolator palindromic), such that either proximal end 217 or distal end 218 of thermal isolator 200 may be disposed more proximate the top of a wall system without changing the manner in which other components of thermal isolator system 250 and/or a wall system as a whole may be coupled or constructed. This reversible or palindromic configuration allows a user to be able to dispose the thermal isolator on in a wall system without worrying whether the thermal isolator is upside down.

In various embodiments, a coupling recess may be disposed through another surface of a thermal isolator, such as through an isolator first and/or second side, and/or through an isolator proximal and/or distal end.

In various embodiments, a coupling recess may span at least a portion of the length between the isolator first and second sides, and/or between the isolator proximal and distal ends. For example, coupling recesses 210 span the full length of thermal isolator between isolator proximal end 217 and distal end 218.

In various embodiments, a coupling recess may have a recess shape. The recess shape may be configured to receive a complementary coupling device to couple a sub-framing member to the respective thermal isolator. The recess shape of a coupling recess may comprise a geometric shape, and/or any suitable shape to facilitate coupling. In various embodiments, a recess shape of a coupling recess may comprise a first portion comprising a first cross-sectional length, and a second portion comprising a second cross-sectional length that is recessed further into the isolator body than the first portion. The first cross-sectional length may be larger than the second cross-sectional length, for example, such that the coupling recess comprises a cross section having a frustum shape (e.g., a frusto-triangular cross-sectional shape). A coupling recess may have one or multiple frustum-shaped portions fluidly connected to one another spanning between the isolator outer surface toward the isolator inner surface. The opening through the isolator outer surface may also comprise a smaller cross-sectional area than the first cross-sectional area. As shown in FIGS. 2A-2C, the recess shape of coupling recesses 210 comprises two fluidly connected frusto-triangular cross-sectional shapes. Each of the frusto-triangular cross-sectional shapes comprises a first cross-sectional length (complementary to a first cross-sectional length 232 of a coupling protrusion 230, discussed further herein) that is larger than a second cross-sectional length (complementary to a second cross-sectional length 234 of coupling protrusion 230). Additionally, the opening of coupling recess 210 through isolator outer surface 201 is smaller than the first cross-sectional length of coupling recess 210. Thus, when a coupling device or coupling protrusion (e.g., coupling protrusion 230) is inserted and/or disposed into a coupling recess (e.g., coupling recess 210), the coupling protrusion may be retained in the coupling recess by a retention surface of the coupling recess closing around and resting proximate or adjacent to the first cross-sectional length of the coupling protrusion (e.g., retention surface 235 closing around and resting proximate or adjacent to first cross-sectional length 232 of a coupling protrusion 230). Thus, a force in an outward direction may be prevented from causing coupling protrusion 230 from exiting coupling recess 210.

In various embodiments, a thermal isolator may comprise any suitable material. Such a material may comprise a material that is relatively less conductive than metal materials to prevent or mitigate the transfer of energy through the thermal isolator. For example, a thermal isolator may comprise a polymeric material, polyvinyl chloride, unplasticized polyvinyl chloride, fiber glass, basalt, polypropylene, a ceramic, a geopolymer (e.g., an aluminosilicate compound), a composite material (e.g., a fiber-reinforced composite material, and/or a non-combustible fiber-reinforced composite material), and/or the like. In various embodiments, a thermal isolator may be a single, integral and/or monolithic component. A thermal isolator may be manufactured by any suitable method such as extrusion, subtractive manufacturing, additive manufacturing, and/or the like.

In various embodiments, a thermal isolator system may comprise a retainer system comprising one or more retainers. The retainer system may be configured to couple a sub-framing member(s) to the thermal isolator. In various embodiments, a retainer system of a thermal isolator system may comprise at least a foundation retainer, which is configured to couple a portion of a sub-framing member (e.g., a foundation portion) to and/or along a surface of the thermal isolator (e.g., an isolator outer surface). For example, thermal isolator system 250 may comprise retainers 220 and 270 coupled to thermal isolator 200. Retainer 220 maybe a foundation retainer, which is configured to couple a portion (e.g., a foundation portion) of the sub-framing system (e.g., sub-framing system 298) to and along isolator outer surface 201. In various embodiments, a retainer system of a thermal isolator system may comprise an extension retainer, which is configured to couple to and/or support an extension portion of a sub-framing system. An extension retainer may extend outwardly from the isolator outer surface. For example, retainer 270 may be an extension retainer, which is configured to couple to and/or support at least a portion (e.g., an extension portion) of the sub-framing system (e.g., sub-framing system 298). In various embodiments, a retainer system may comprise multiple foundation retainers, for example, to couple to a sub-framing system having two foundation portions coupled along the outer surface of the thermal isolator (e.g., a trapezoidal sub-framing member).

A retainer of a thermal isolator system may comprise at least one retainer flange and at least one coupling protrusion protruding from the retainer flange. For example, retainer 220 may comprise retainer flange 224 and coupling protrusion 230, and retainer 270 may comprise retainer flanges 272 and 274 and coupling protrusion 280. In various embodiments, the retainer flange of a foundation retainer may extend into and/or along an isolator outer surface of the thermal isolator (e.g., from a side or edge, a portion proximate thereto, or any other portion, of the thermal isolator), such that a foundation portion of a sub-framing system may be disposed between the retainer flange and the isolator outer surface. The retainer flange for a foundation flange may be biased in an inward direction (e.g., toward the isolator outer surface, e.g., substantially along first axis X). For example, retainer flange 224 may be biased toward isolator outer surface 201, such that there is a clamping force or pressure on and/or toward isolator outer surface 201 from retainer flange 224 (which may facilitate coupling of sub-framing member 260 to thermal isolator 200). In various embodiments, a retainer (e.g., a foundation retainer) may comprise a spacer portion (e.g., spacer portion 222), which may provide spacing between at least a portion of the retainer flange (e.g., retainer flange 224) and the isolator outer surface (e.g., isolator outer surface 201). In various embodiments, the retainer flange may comprise an end lip that extends from the flange in a direction different from (e.g., generally opposite of) the direction of the flange bias. For example, retainer 220 may comprise end lip 226 on the end of retainer flange 224 extending in a different direction than the bias of retainer flange 224. End lip 226 provides space between retainer flange 224 at the end thereof and isolator outer surface 201, to facilitate a sub-framing member foundation portion 262 being moved and/or disposed under retainer flange 224 (e.g., moving sub-framing member 260 in a direction substantially along second axis Y).

In various embodiments, the retainer flange(s) of an extension retainer may extend outwardly from an isolator outer surface of the thermal isolator (e.g., substantially along first axis X), such that an extension portion of a sub-framing system may be supported and/or secured by the retainer flange(s). An extension retainer may be positioned and/or extend from the isolator outer surface at a side or edge, a portion proximate thereto, or any other portion, of the thermal isolator. An extension retainer may comprise two flanges, between which a portion of the sub-framing system is disposed and retained (e.g., an extension portion of the sub-framing system). At least one of the two flanges may have a bias toward the space between the two flanges, such that there is a force between the two flanges (e.g., a pinching force) for retaining the respective sub-framing member therein. For example, extension retainer 270 may comprise a first flange 272 and a second flange 274, having flange space 276 therebetween. The second flange 274 may be biased in a direction toward flange space 276 and/or first flange 272 (e.g., substantially along second axis Y), as indicated by the indented shape of second flange 274 toward first flange 272. Such an indented shape, making the opening of the flange space larger than a portion of in the middle of the flange space, may facilitate easier insertion of the respective sub-framing member portion (sub-framing member portion 292) into the space between the extension retainer flanges (e.g., flange space 276). In various embodiments, one or more of the flanges may comprise an end lip similar to end lip 226, which may open the entrance to flange space 276 to facilitate easier insertion and/or positioning of the respective sub-framing member therein.

The coupling protrusion of a retainer may span at least a portion along the respective retainer. For example, coupling protrusion 230 of retainer 220 and coupling protrusion 280 of retainer 270 may span the entire length of the respective retainers. In various embodiments, a coupling protrusion may span only a portion of the length of a retainer. In various embodiments, the coupling protrusion of a retainer may be disposed in any suitable position relative to the retainer flange of the retainer. For example, a coupling protrusion may extend in a direction that is substantially perpendicular to the direction in which the retainer flange extends (e.g., coupling protrusion 230 extending substantially perpendicular to retainer flange 224). As another example, a coupling protrusion may extend in a direction that is substantially parallel to and/or aligned with the direction in which the retainer flange extends (e.g., coupling protrusion 280 extending substantially aligned with, or parallel to, retainer flanges 272 and 274).

A coupling protrusion of a retainer may comprise any suitable shape to facilitate coupling to a thermal isolator. For example, a coupling protrusion may comprise a shape that is complementary to a shape of the respective coupling recess in the thermal isolator into which the coupling protrusion is configured to be inserted. In various embodiments, a protrusion shape of a coupling protrusion may comprise a first portion comprising a first cross-sectional length, and a second portion comprising a second cross-sectional length that is protruding further than the first portion. The first cross-sectional length may be larger than the second cross-sectional length, for example, such that the coupling protrusion comprises a cross section having a frustum shape (e.g., a frusto-triangular cross-sectional shape). A coupling protrusion may have one or multiple frustum-shaped portions coupled to one another (e.g., along an axis or side-by-side). The portion of the coupling protrusion coupling the coupling protrusion to the retainer flange may also comprise a smaller cross-sectional area than the first cross-sectional area. As shown in FIGS. 2A-2C, the coupling protrusion shape of coupling protrusions 230 and 280 comprises two frusto-triangular cross-sectional shapes coupled to one another along an axis. Each of the frusto-triangular cross-sectional shapes comprises a first cross-sectional length 232 that is larger than a second cross-sectional length 234. Additionally, the portion of the coupling protrusion coupling the coupling protrusion to the retainer flange is smaller than the first cross-sectional length of coupling recess 210. Thus, when a coupling protrusion (e.g., coupling protrusion 230) is inserted and/or disposed into a coupling recess (e.g., coupling recess 210), the coupling protrusion may be retained in the coupling recess by a retention surface of the coupling recess closing around and resting proximate or adjacent to the first cross-sectional length of the coupling protrusion (e.g., retention surface 235 closing around and resting proximate or adjacent to first cross-sectional length 232 of a coupling protrusion 230). Thus, a force in an outward direction may be prevented from causing coupling protrusion 230 to exit coupling recess 210.

In various embodiments, a coupling recess may be disposed proximate a side or edge of the isolator body. Accordingly, in response to a complementary coupling protrusion on a retainer being inserted into the coupling recess, a respective portion of the isolator body between the coupling protrusion and the respective side or edge of the isolator body (e.g., end portion 211) may shift, bend, flex, or pivot from an original position to allow insertion of the first portion of the coupling protrusion (having a larger first cross-sectional area than the opening to the coupling recess). In response to the first portion of the coupling protrusion passing through the opening of the coupling recess and resting in the first portion of the coupling recess having a complementary cross-sectional length (i.e., in response to the first cross-sectional area of the coupling protrusion crossing the isolator outer surface into the first coupling recess), the end portion of the isolator body may shift back substantially to the original position.

In various embodiments, a retainer may be coupled to the thermal isolator by disposing a fastener through the retainer and into the thermal isolator (e.g., a screw, bolt, and/or the like being disposed through the retainer and into a coupling recess, which may comprise a complementary shape to the fastener (e.g., complementary cross-sectional shape, threading, etc.)).

In various embodiments, a retainer for a thermal isolator system may comprise any suitable material. Such a material may comprise a material that is relatively less conductive than metal materials to prevent or mitigate the transfer of energy through the thermal isolator system. For example, a retainer may comprise a polymeric material, polyvinyl chloride, unplasticized polyvinyl chloride, fiber glass, basalt, polypropylene, and/or the like. In various embodiments, a retainer may be a single, integral and/or monolithic component. A retainer may be manufactured by any suitable method such as extrusion, subtractive manufacturing, additive manufacturing, and/or the like.

In various embodiments, the sub-framing system of a thermal isolator system may comprise any suitable configuration, shape, and/or combination. In various embodiments, a sub-framing system may comprise a foundation portion, an extension portion, and/or a retention portion. A foundation portion of the sub-framing system may be a portion that couples to a more-inward component of the respective wall system, such as the inner wall and/or a thermal isolator (thus, providing a foundation for the sub-framing system). An extension portion may be a portion that extends from the foundation portion and/or the more inward wall system component (e.g., which may create a space in which insulation or other material may be disposed in the wall system). The extension portion may extend substantially perpendicularly from the foundation portion. A retention portion may be a portion that extends from the extension portion, and may be configured to retain insulation or other material that is disposed in the wall system in the space created by the extension portion of the sub-framing system.

As shown in FIGS. 2A-2C, a sub-framing system 298 may comprise two L-shaped sub-framing members, a first sub-framing member 260 and a second sub-framing member 290. First sub-framing member 260 may provide foundation portion 262, which is coupled to and along isolator outer surface 201 by retainer 220. Retainer 220 may press on an outer surface of foundation portion 262 of first sub-framing member 260, coupling first sub-framing member 260 to and along isolator body 205. Second sub-framing member 290 may provide retention portion 294, creating a space between retention portion 294 and a more inward wall system component (e.g., an inner wall and/or thermal isolator 200). The extension portion of sub-framing system 298 may be provided by first sub-framing member 260 and second sub-framing member 290. First sub-framing member 260 may comprise a first extension portion 264 extending outwardly from foundation portion 262 (substantially perpendicularly from foundation portion 262 and/or isolator outer surface 201). Second sub-framing member 290 may comprise a second extension portion 292 extending outwardly from isolator outer surface 201 (substantially perpendicularly thereto). Second sub-framing member 290 may be coupled to thermal isolator 200 by support retainer 270, wherein second extension portion 292 may be disposed in flange space 276 between first retainer flanges 272 and 274. Thus, first extension portion 264 may be coupled to, and/or disposed adjacent to, second extension portion 292 via second extension portion 292 being retained in position by support retainer 270.

In various embodiments, first extension portion 264 may be coupled to second extension portion 292 (and/or a support retainer, such as support retainer 270) via a fastener (e.g., a bolt, screw, nail, and/or the like, such as bolt 198) being disposed through first extension portion 264, second extension portion 292, and/or one or more flanges of support retainer 270. To facilitate such coupling, first sub-framing member 260 may comprise a coupling hole 269 disposed through first extension portion 264, support retainer 270 may comprise a coupling hole 289 disposed through the retainer flanges 272 and 274, and/or second sub-framing member 290 may comprise a coupling hold disposed through second extension portion 292. The positions and shapes of the coupling holes may be complementary between first sub-framing member 260, second sub-framing member 290, and/or support retainer 270, such that the components will couple together and be positioned in a desired configuration. The positions of the various components (e.g., sub-framing members relative to the thermal isolator or other portions of the wall system) may be retained by the retainers, which may hold sub-framing members in place before fasteners are applied.

In various embodiments, the length of the extension portion of sub-framing system 298 may be adjusted by adjusting the position of second sub-framing member 290 within flange space 276 along the first axis X. For example, for more (or less) space between retention portion 294 and a more inward wall system component (e.g., an inner wall and/or thermal isolator 200), second sub-framing member 290 may be moved outwardly (or inwardly) before being coupled by a fastener to the other thermal isolator system components. To do so, a coupling hole may be created on first extension portion 264 and/or second extension portion 292 at a desired position, and/or first extension portion 264 and/or second extension portion 292 may comprise multiple coupling holes to select a desired position. This would allow adjustment of the sub-framing system to accommodate different amounts and/or thicknesses of insulation within a wall system.

Additionally, sub-framing system 298 comprising two L-shapes sub-framing members coupled as shown and discussed herein may further prevent or mitigate the transfer of energy (e.g., thermal energy) through thermal isolator system 250 between an interior and exterior of the wall system or building. For example, sub-framing members 260 and 290 may comprise conductive materials such as metal, and therefore, energy may readily travel through each individual sub-framing member. However, first sub-framing member 260 may be physically separated from second sub-framing member 290 by support retainer 270 (e.g., by second flange 274 of support retainer 270 being disposed between first extension portion 264 of first sub-framing member 260 and second extension portion 292 of second sub-framing member 290). Support retainer 270 may comprise a relatively less conductive material (as discussed herein), and therefore, energy traveling through one sub-framing member may be prevented from transferring to the other sub-framing member (or such transfer may be inhibited or lessened).

In various embodiments, in which a sub-framing system may comprise multiple sub-framing members (e.g., two L-shaped sub-framing members like in sub-framing system 298), at least two of the multiple sub-framing members may comprise different materials. For example, an outward sub-framing member (e.g., sub-framing member 290 of sub-framing system 298) may comprise aluminum or an aluminum alloy, as aluminum may be easier to shape than other metal materials (e.g., to form a certain shape of the retention portion of the sub-framing system). An inner sub-framing member (e.g., sub-framing member 290 of sub-framing system 298) may comprise steel for its relatively higher strength to provide a stronger foundation and coupling of the sub-framing system to the other wall system components, such as a thermal isolator and/or inner wall. These sub-framing members having dissimilar materials may protect and/or mitigate against galvanic corrosion occurring between the sub-framing members.

Figure 3:
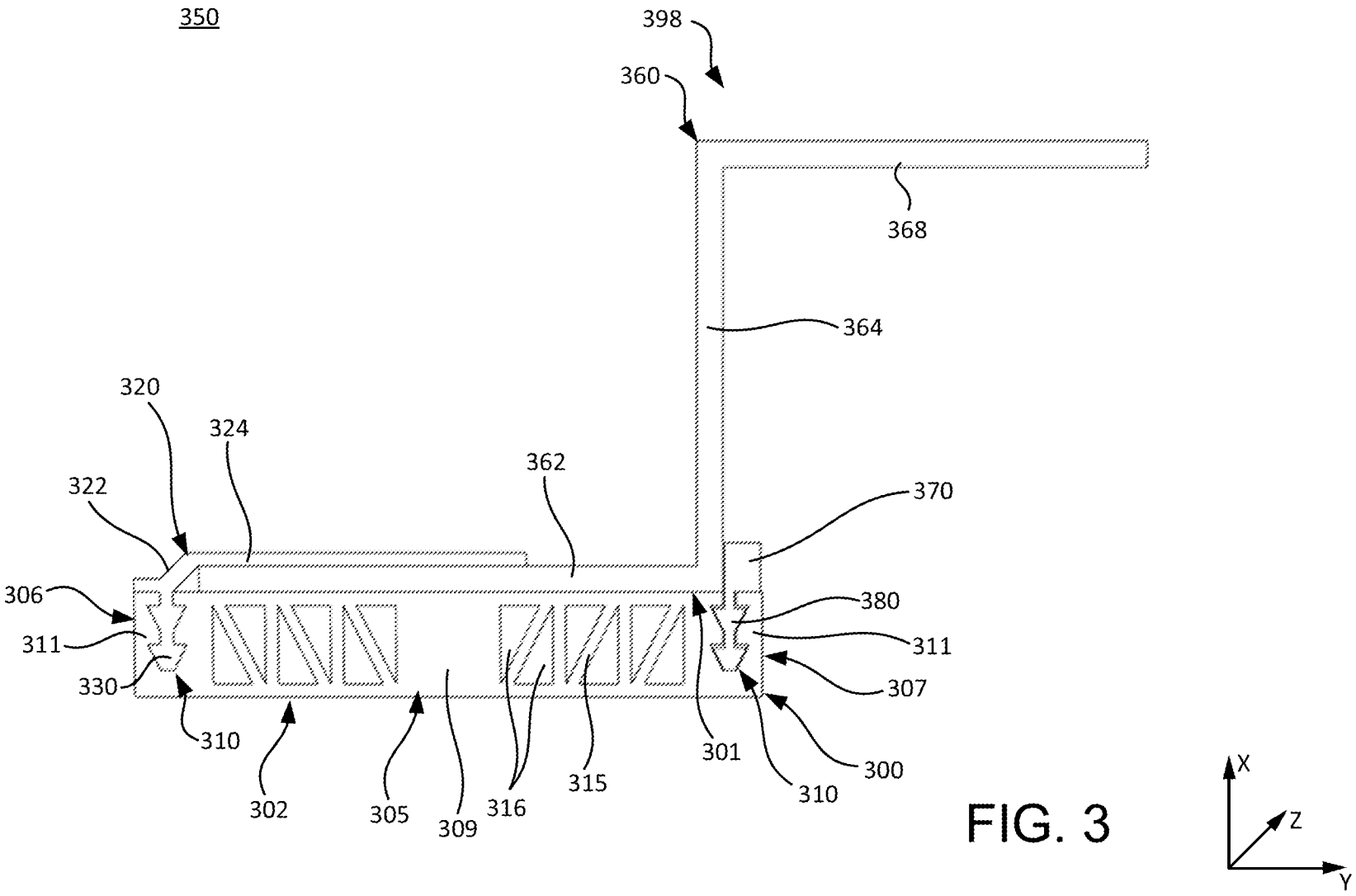
FIG. 3 illustrates a view of another thermal isolator system, in accordance with various embodiments.

As shown in FIG. 3, thermal isolator system 350 may comprise a thermal isolator 300. Thermal isolator 300 and its components (e.g., isolator body 305, isolator outer surface 301, isolator inner surface 302, isolator first side 306, isolator second side 307, hollow voids 316, support beams 315, coupling recesses 310, solid portion 309, and end portions 311) may be similar to thermal isolator 200 and its components (e.g., isolator body 205, isolator outer surface 201, isolator inner surface 202, isolator first side 206, isolator second side 207, hollow voids 216, support beams 215, coupling recesses 210, solid portion 209, and end portions 211, respectively) discussed herein. Similarly, the retainer system of thermal isolator system 350 and its components (e.g., foundation retainer 320, spacer portion 322, retainer flange 324, and coupling protrusions 330 and 380) may be similar to the retainer system of thermal isolator system 250 and its components (e.g., foundation retainer 220, spacer portion 222, retainer flange 224, and coupling protrusions 230 and 280) discussed herein.

Thermal isolator system 350 may comprise a sub-framing system 398 having one Z-shaped sub-framing member, sub-framing member 360. Sub-framing member 360 may comprise a foundation portion 362, which is coupled to and along isolator outer surface 301 by retainer 320. Retainer 320 may press on an outer surface of foundation portion 362 of sub-framing member 360, coupling sub-framing member 360 to and along isolator body 305. Sub-framing member 360 may comprise an extension portion 364 extending outwardly from foundation portion 362 (substantially perpendicularly from foundation portion 362 and/or isolator outer surface 301). Sub-framing member 360 may comprise a retention portion 368, creating a space between retention portion 368 and a more inward wall system component (e.g., an inner wall and/or thermal isolator 200).

Support retainer 370 in thermal isolator system 350 may comprise one flange disposed adjacent to extension portion 364. Support retainer 370 may be configured to support the position of sub-framing member 360, by preventing sub-framing member 360 from translating in a direction along second axis Y.

In various embodiments, a support retainer may be selected and/or modified based on the sub-framing member to be used in a thermal isolator system or wall system. If a sub-framing system that extends further from the thermal isolator and inner wall is desired, the support retainer may be selected and/or designed to extend further from the isolator outer surface to provide more support along the longer or further-extending sub-framing system. If a sub-framing system that extends less from the thermal isolator and inner wall is desired, the support retainer may be selected and/or designed to extend less from the isolator outer surface.

In various embodiments, the foundation portion of a sub-framing system may be coupled to a thermal isolator via a foundation retainer. In various embodiments, the foundation portion of a sub-framing system may be further coupled to the thermal isolator via a fastener (e.g., bolts 192) being disposed through the foundation retainer, foundation portion of a sub-framing system, and/or the thermal isolator. For example, coupling voids 239 may be disposed through foundation retainer 220, and coupling holes 268 may be disposed through sub-framing member 260 (or sub-framing member 360) through which the fastener may pass, and into coupling voids 219 in thermal isolator 200. The fastener passing therethrough may further extend into the inner wall of the wall system to couple the thermal isolator system to the inner wall. The positions of the coupling holes in the various components may be complementary to one another to facilitate coupling.

In various embodiments, the L-shaped sub-framing members used in a sub-framing system may be rigid, integral, and/or monolithic components. Similarly, the Z-shaped sub-framing members used in a sub-framing system may be rigid, integral, and/or monolithic components. The sub-framing members used in a wall system may comprise any suitable material such as a metal or metal alloy (e.g., steel, aluminum, aluminum alloy, and/or the like), a composite material, a ceramic material, and/or the like).

The thermal isolator systems discussed herein prevent or mitigate the transfer of energy between the sub-framing system and other components of the wall system. For example, if a sub-framing system comprises a sub-framing member(s) comprising conductive materials such as metal, energy may readily travel through each individual sub-framing member. However, the thermal isolator may comprise a relatively less conductive material (as discussed herein), and may physically separate and thermally isolate the sub-framing system from more inward components of the wall system. Therefore, energy traveling through the sub-framing system may be prevented from transferring to more inward components of the wall system (e.g., an inner wall) and/or the interior of the building. Thus, thermal isolator systems in accordance with embodiments of this disclosure may cause temperature control measures within buildings to be less effected by external conditions (e.g., hot or cold weather). According, the disclosed thermal isolator systems and their components may facilitate energy savings and greater efficiency with regard to temperature control within buildings.

In various embodiments, a thermal isolator system may be disposed at any suitable position within a wall system. For example, as shown in FIGS. 1A-1C, along a horizontal of the wall system, a thermal isolator system may be disposed periodically in a complementary manner to the positions of the sub-framing members in the wall system. In various embodiments, sub-framing members in a wall system may span continuously for a length of the wall system (e.g., between a top and bottom of the wall system), and thus, a sub-framing member may be incorporated into more than one thermal isolator system. Therefore, along a vertical of the wall system, as shown in FIGS. 1A and 1B, a thermal isolator system may be disposed periodically (e.g., along a sub-framing member or sub-framing system). The thermal isolator systems may be disposed at regular or equal intervals along the vertical of the wall system.

In various embodiments, as shown in FIG. 1C, the thermal isolator (e.g., thermal isolator 152C) of a thermal isolator system may span continuously along a length or height of the wall system (e.g., complementary to the spanning of a sub-framing member(s)). That way, thermal isolator systems may be established at any desired point along the vertical by coupling a retainer(s) to the continuous thermal isolator. Additionally, with a continuous thermal isolator, the sub-framing system is physically separated (e.g., by a physical object and not simply air) continuously. The thermal isolator systems (comprising retainers) may be spaced in any desired manner (e.g., at equal or unequal intervals along the vertical). To facilitate equal spacing of thermal isolator systems, measurement spacers may be placed between thermal isolator systems (e.g., measurement spacers 175). For example, a certain number of measurement spacers of a certain size maybe placed between each thermal isolator system to facilitate equal spacing thereof. The measurement spacers may comprise coupling protrusions similar to those discussed in relation to the thermal isolator system retainers. Therefore, the coupling protrusions of the measurement spacers may be inserted into the coupling recesses of the thermal isolators to couple the measurement spacers to the thermal isolators.

In various embodiments, a thermal isolator may be disposed at any suitable position within a wall system (e.g., along an inner wall). For example, thermal isolator 152 (in FIGS. 1A and 1B) may be disposed periodically along a vertical axis of wall systems 100A and 100B, respectively. As another example, thermal isolator 152C (in FIG. 1C) may be disposed continuously along a length or height of wall system 100C (e.g., along a vertical axis). In various embodiments, a user of a thermal isolator may decide based on the specific construction project how to dispose a thermal isolator. A thermal isolator may begin as one solid, continuous piece (e.g., capable to spanning continuously along a length or height of a wall system). However, if a construction project calls for periodic thermal isolators, the continuous thermal isolator may be separated into one or more shorter thermal isolators to be disposed periodically along a wall system and/or its components.

In various embodiments, to facilitate the separation of a long, continuous thermal isolator (e.g., thermal isolator 150C) into multiple shorter thermal isolators, a thermal isolator may comprise a breakage line spanning between two edges of the isolator body along which the thermal isolator may be cut or severed to form the multiple shorter thermal isolators. For example, with reference to FIGS. 2A-2C, thermal isolator 200 may comprise a breakage line 221 spanning between isolator first side 206 and isolator second side 207. Breakage line 221 may comprise serrations, perforations, scoring, less material than other portions of isolator body 205 (e.g., a cross section along breakage line 221 may comprise a smaller cross-sectional surface area than a parallel cross-section taken at a different location on isolator body 205), and/or the like to facilitate breaking thermal isolator 200 along breakage line 221 to create two shorter thermal isolators. As a further example of breakage lines, thermal isolator 200 may have been formed by being severed from a longer, continuous thermal isolator, wherein proximal end 217 and distal end 218 are the locations of the breakage lines before thermal isolator 200 was formed. Breakage lines may be spaced at any suitable interval, such as every four, six, eight, ten, or twelve inches along the continuous thermal isolator.

In various embodiments, retainers for thermal isolator systems may be similarly formed (e.g., starting as long, continuous retainers, and being broken into shorter retainers). Thus, retainers may similarly comprise breakage lines.

The sizeable and modular nature of the thermal isolator systems disclosed herein provide advantageous benefits for using such thermal isolator systems in wall systems and construction projects. For instance, the thermal isolators and/or retainers may be sized to fit a certain project or certain area in a wall system (e.g., by severing along a breakage line). Any unused thermal isolators and/or retainers (or portions thereof) may be used in another part of the, or in a separate, construction project. Retainers for the thermal isolator systems may each have a coupling protrusion having a shape complementary to the shape of the coupling recesses of the thermal isolators. That way, based on the project, the space in which the thermal isolator system will be disposed, the sub-framing system and sub-framing members to be used, and/or other constructions conditions, different retainers can be selected, used, and coupled to the thermal isolator(s) to achieve desired results (e.g., coupling certain sizes, lengths, and/or types of sub-framing members within the wall system). Additionally, in response to a thermal isolator having a continuous coupling recess spanning a length of the isolator body, the retainers may be coupled to a thermal isolator at any suitable location to facilitate coupling to sub-framing members and other wall system components at desired locations along the wall system. Thus, a length of a coupling recess in an isolator body may be longer than a coupling protrusion of a retainer, allowing flexibility in positioning the coupling protrusion and the associated retainer along the coupling recess in the isolator body.

Figure 4:
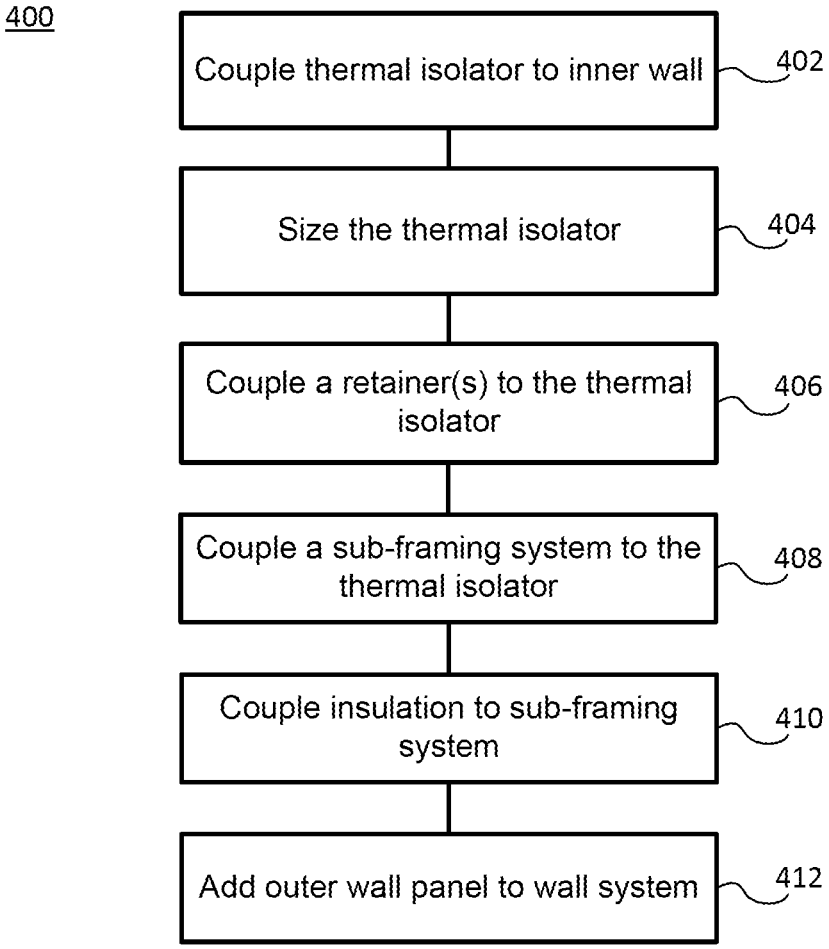
FIG. 4 illustrates a method of constructing a wall system, in accordance with various embodiments.

FIG. 4 depicts a method 400 of constructing a wall system, in accordance with various embodiments. In various embodiments, with additional reference to FIGS. 1A-1C and 2A-2C, a thermal isolator (e.g., thermal isolator 152 or 152C) may be coupled to an inner wall (e.g., inner wall 110) (step 402). The thermal isolator may be coupled to the inner wall in any suitable manner, such as adhesive or a fastener (e.g., a bolt, screw, nail, or the like). The thermal isolator may be sized (step 404) to a desired length. For example, a continuous thermal isolator (e.g., thermal isolator 152C) may be disposed in the wall system, or a thermal isolator may be sized (e.g., by severing a continuous thermal isolator into multiple shorter thermal isolators) and coupled to the inner wall. Sizing the thermal isolator may occur before and/or after the thermal isolator is coupled to the inner wall.

In various embodiments, a retainer(s) may be coupled to the thermal isolator (step 406). For example, a retainer may be coupled to a thermal isolator by inserting the coupling protrusion of the retainer into the coupling recess of the thermal isolator. As discussed herein, one or more retainers may be couples to a thermal isolator. The retainer(s) may be coupled to thermal isolator before and/or after the thermal isolator is coupled to the inner wall, and/or before and/or after the thermal isolator is sized. In various embodiments, one retainer may be coupled to thermal isolator after one step in method 400, but before another.

In various embodiments, a sub-framing system may be coupled to the thermal isolator (step 408). For example, a foundation portion of a sub-framing system may be coupled to an isolator outer surface by a foundation retainer (e.g., foundation portion 262 of sub-framing system 298 may be coupled to isolator outer surface 201 by retainer 220). In various embodiments, coupling a sub-framing member to a thermal isolator may occur before and/or after any other step in method 400. For example, with reference to FIGS. 2A-2C, sub-framing member 260 may be disposed on thermal isolator 200, and then retainer 220 may be coupled to thermal isolator 200, or retainer 220 may be coupled to thermal isolator 200, and then sub-framing member 260 may be disposed under retainer flange 224. Additionally, sub-framing member 290 may be coupled to thermal isolator 200 by being coupled to support retainer 270. Sub-framing member 290 maybe coupled to support retainer 270 before or after retainer 270 is coupled to thermal isolator 200. Further, sub-framing member 260 may be coupled to thermal isolator before and/or after retainer 270 and/or sub-framing member 290 is coupled to thermal isolator. Along similar lines, and with reference to FIG. 3, sub-framing member 360 may be coupled to thermal isolator 300 before or after retainer 370 is coupled to thermal isolator 300. Overall, the steps to form a thermal isolator system and couple it to an inner wall or other wall system component may comprise any order, combination, or repetition of steps 402-408, as appropriate.

In various embodiments, various surfaces within the thermal isolator system may comprise texturing to increase friction between the components, mitigating the risk that components will shift or translate relative to one another. For example, the outer surfaces of a coupling protrusion and/or a coupling recess may be textured to retain the coupling protrusion in the respective coupling recess. As another example, the isolator outer surface and/or retainer surfaces may be textured to maintain the position of sub-framing members coupled thereto. In various embodiments, an adhesive may be disposed between thermal isolator system components to further strengthen the coupling therebetween. For example, adhesive may be disposed between coupling protrusions and coupling recesses, between sub-framing members and the thermal isolator, between sub-framing members and a respective retainer, and/or the like.

In various embodiments, in response to the thermal isolator system being assembled and coupled within the wall system (e.g., to the inner wall), insulation may be disposed in the wall system and coupled to the sub-framing system (step 410). For example, insulation 120 may be disposed in the space inward of the retention portion of the sub-framing system.

In various embodiments, an outer wall panel may be added to the wall system (step 412). For example, outer wall panels 140 may be coupled to a sub-framing system (e.g., sub-framing member 160A) or to insulation 120. As discussed, there may be an air space between the insulation and the outer wall panel.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Despite the foregoing description herein relating to a wall system of a building, it would not be outside the scope of this disclosure to implement the systems and methods disclosed herein into wall systems for other things, such as objects or vehicles.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods, and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A system, comprising:

a thermal isolator configured to be coupled to an inner wall of a wall system, wherein the thermal isolator comprises an isolator body spanning along a first axis between an isolator outer surface and an isolator inner surface and along a second axis between an isolator first side and an isolator second side, and a first coupling recess disposed through the isolator outer surface and into the isolator body, wherein the first coupling recess comprises a recess shape, wherein the first axis and the second axis are substantially perpendicular;

a first retainer comprising a first coupling protrusion having a first protrusion shape that is complementary to the recess shape, wherein the first retainer is configured to be coupled to the thermal isolator by the first coupling protrusion being disposed in the first coupling recess of the thermal isolator; and a sub-framing system comprising a foundation portion coupled to the thermal isolator by the first retainer and an extension portion extending away from the isolator outer surface, wherein the first retainer spans along the isolator outer surface to couple the foundation portion of the sub-framing system to the isolator outer surface, and wherein a second retainer extends outwardly from the isolator outer surface and is configured to at least one of contact or support the extension portion of the sub-framing system.

2. The system of claim 1, wherein the isolator body comprises a solid portion that is solid between the isolator outer surface and the isolator inner surface.

3. The system of claim 2, wherein thermal isolator comprises a coupling void disposed through the isolator body from the isolator outer surface to the isolator inner surface configured to receive a fastener to fasten the thermal isolator to the inner wall, wherein the coupling void is disposed through the solid portion of the isolator body.

4. The system of claim 2, wherein the isolator body comprises at least one hollow void spanning internally therein and between the isolator outer surface and the isolator inner surface.

5. The system of claim 4, wherein the hollow void is disposed between the solid portion of the isolator body and at least one of the isolator first side and the isolator second side.

6. The system of claim 1, wherein the first coupling recess is disposed proximate the isolator first side or the isolator second side.

7. The system of claim 6, wherein the first coupling recess is disposed proximate the isolator first side and a first distance therefrom, wherein the thermal isolator comprises a second coupling recess disposed proximate the second side and a second distance therefrom.

8. The system of claim 7, wherein the first distance and the second distance are the same.

9. The system of claim 8, further comprising a second retainer comprising a second coupling protrusion having a second protrusion shape complementary to a second recess shape of the second coupling recess, wherein the second retainer is configured to be coupled to the thermal isolator by the second coupling protrusion being disposed in the second coupling recess of the thermal isolator.

10. The system of claim 1, wherein the sub-framing system comprises a sub-framing member having an L-shape.

11. The system of claim 1, wherein the sub-framing member comprises a sub-framing member having a Z-shape.

12. The system of claim 1, wherein the sub-framing system comprises a first sub-framing member comprising the foundation portion and the extension portion, and a second sub-framing member coupled to the second retainer and extending outwardly from the isolator outer surface, wherein the extension portion of the first sub-framing member and the second sub-framing member at least partially overlap.

13. The system of claim 1, wherein the first protrusion shape comprises a first portion comprising a first cross-sectional length, and a second portion comprising a second cross-sectional length that is protruding further than the first portion, wherein the first cross-sectional length is greater than the second cross-sectional length.

14. The system of claim 13, wherein the first coupling recess is disposed proximate the isolator first side or the isolator second side of the thermal isolator, such that, in response to the first coupling protrusion being inserted into the first coupling recess, a respective end portion of the thermal isolator between the first coupling recess and a respective isolator end is able to shift from an original position to allow the first cross-sectional length into the first coupling recess, and shift back substantially to the original position in response to the first cross-sectional length crossing the isolator outer surface into the first coupling recess.

15. The system of claim 1, wherein the first coupling recess spans along the outer surface of the thermal isolator between a proximal end and a distal end of the thermal isolator for a length longer than a length of the coupling protrusion of the first retainer, which allows the first retainer to be coupled to the thermal isolator at a desired position.

16. A wall system, comprising:

an inner wall comprising an inner wall surface; and the system of claim 1, wherein the isolator inner surface of the thermal isolator is coupled to the inner wall surface.

17. The wall system of claim 16, further comprising insulation disposed along the isolator outer surface and supported by the sub-framing system.

18. A system, comprising:

a thermal isolator configured to be coupled to an inner wall of a wall system, wherein the thermal isolator comprises an isolator body spanning along a first axis between an isolator outer surface and an isolator inner surface and along a second axis between an isolator first side and an isolator second side, and a first coupling recess disposed through the isolator outer surface and into the isolator body, wherein the first coupling recess comprises a recess shape, wherein the first axis and the second axis are substantially perpendicular; and a first retainer comprising a first coupling protrusion having a first protrusion shape that is complementary to the recess shape, wherein the first retainer is configured to be coupled to the thermal isolator by the first coupling protrusion being disposed in the first coupling recess of the thermal isolator, wherein the first protrusion shape comprises a first portion comprising a first cross-sectional length, and a second portion comprising a second cross-sectional length that is protruding further than the first portion, wherein the first cross-sectional length is greater than the second cross-sectional length, wherein the first coupling recess is disposed proximate the isolator first side or the isolator second side of the thermal isolator, such that, in response to the first coupling protrusion being inserted into the first coupling recess, a respective end portion of the thermal isolator between the first coupling recess and a respective isolator end is able to shift from an original position to allow the first cross-sectional length into the first coupling recess, and shift back substantially to the original position in response to the first cross-sectional length crossing the isolator outer surface into the first coupling recess.

19. A system, comprising:

a thermal isolator configured to be coupled to an inner wall of a wall system, wherein the thermal isolator comprises an isolator body spanning along a first axis between an isolator outer surface and an isolator inner surface and along a second axis between an isolator first side and an isolator second side, and a first coupling recess disposed through the isolator outer surface and into the isolator body, wherein the first coupling recess comprises a recess shape, wherein the first axis and the second axis are substantially perpendicular; and a first retainer comprising a first coupling protrusion having a first protrusion shape that is complementary to the recess shape, wherein the first retainer is configured to be coupled to the thermal isolator by the first coupling protrusion being disposed in the first coupling recess of the thermal isolator, wherein the thermal isolator comprises a proximal end and a distal end, wherein the isolator body spans an isolator length between the proximal end and the distal end along a third axis, wherein the third axis is substantially perpendicular to the first axis and the second axis, wherein the thermal isolator comprises a breakage line spanning between the isolator first side and the isolator second side of the thermal isolator at a position along the isolator length, wherein the breakage line comprises a line along which the thermal isolator is able to be broken to shorten the isolator length.

20. A system, comprising:

a thermal isolator configured to be coupled to an inner wall of a wall system, wherein the thermal isolator comprises an isolator body spanning along a first axis between an isolator outer surface and an isolator inner surface and along a second axis between an isolator first side and an isolator second side, and a first coupling recess disposed through the isolator outer surface and into the isolator body, wherein the first coupling recess comprises a recess shape, wherein the first axis and the second axis are substantially perpendicular; and a first retainer comprising a first coupling protrusion having a first protrusion shape that is complementary to the recess shape, wherein the first retainer is configured to be coupled to the thermal isolator by the first coupling protrusion being disposed in the first coupling recess of the thermal isolator, wherein the first coupling recess spans along the outer surface of the thermal isolator between a proximal end and a distal end of the thermal isolator for a length longer than a length of the coupling protrusion of the first retainer, which allows the first retainer to be coupled to the thermal isolator at a desired position.

* * * * *